US007133495B2

(12) United States Patent
Nakamura et al.

(10) Patent No.: US 7,133,495 B2
(45) Date of Patent: Nov. 7, 2006

(54) X-RAY GENERATOR

(75) Inventors: Tsutomu Nakamura, Hamamatsu (JP); Masayoshi Ishikawa, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/473,178

(22) PCT Filed: Mar. 28, 2002

(86) PCT No.: PCT/JP02/03091

§ 371 (c)(1),
(2), (4) Date: Feb. 3, 2004

(87) PCT Pub. No.: WO02/080631

PCT Pub. Date: Oct. 10, 2002

(65) Prior Publication Data

US 2004/0109537 A1 Jun. 10, 2004

(30) Foreign Application Priority Data

Mar. 29, 2001 (JP) ..... 2001-096181

(51) Int. Cl.
*H05G 1/56* (2006.01)

(52) U.S. Cl. ..... 378/114; 378/113; 378/101

(58) Field of Classification Search ..... 378/101–114, 378/119, 121, 122, 136, 138
See application file for complete search history.

(56) References Cited

U.S. PATENT DOCUMENTS

| | | | | |
|---|---|---|---|---|
| 3,783,287 | A * | 1/1974 | Fulton et al. | 378/112 |
| 4,631,742 | A * | 12/1986 | Oliver | 378/113 |
| 5,517,545 | A * | 5/1996 | Nakamura et al. | 378/101 |
| 6,816,573 | B1 * | 11/2004 | Hirano et al. | 378/114 |

FOREIGN PATENT DOCUMENTS

| | | |
|---|---|---|
| JP | 57-045000 | 3/1982 |
| JP | 62-246300 | 10/1987 |
| JP | 03-062500 | 3/1991 |
| JP | 07-029532 | 1/1995 |
| JP | 09-266094 | 10/1997 |
| JP | 2000-260594 | 9/2000 |

* cited by examiner

*Primary Examiner*—Edward J. Glick
*Assistant Examiner*—Jurie Yun
(74) *Attorney, Agent, or Firm*—Drinker Biddle & Reath LLP

(57) ABSTRACT

An X-ray generator 1 includes an X-ray tube 11 having a cathode portion 16, a grid electrode 15 and a target 22, a voltage controller 27 and 32 for controlling voltages to be applied to the cathode portion 16 and the grid electrode 15, and switches 33 and 34 for operating ON and OFF of the X-ray generator 1 and of X-ray emission. The voltage controller 27 and 32, based on an ON-signal for the X-ray generator 1 and an OFF-signal for the X-ray emission, applies a positive standby voltage $V_{f1}$ to the cathode portion 16 and applies a negative cutoff voltage $V_{c1}$ to the grid electrode 15.

6 Claims, 8 Drawing Sheets

DRIVE SW
ON
OFF

CATHODE PORTION SW
ON
OFF

X-RAY SW
ON
OFF

GRID VOLTAGE
0
Vc2
Vc1

HEATER VOLTAGE
Vf2
Vf1
0

X-RAY EMISSION
YES
NONE

DRIVE SW
ON
OFF

CATHODE PORTION SW
ON
OFF

X-RAY SW
ON
OFF

GRID VOLTAGE
0
Vc2
Vc1

HEATER VOLTAGE
Vf2
Vf1
0

X-RAY EMISSION
YES
NONE

PRIOR ART

X-RAY GENERATOR

TECHNICAL FIELD

The present invention relates to an X-ray generator which generates X-rays.

BACKGROUND ART

Such an X-ray generator includes one disclosed in Japanese Unexamined Patent Publication No. 7 (1995)-29532. This X-ray generator includes a cathode portion which emits thermoelectrons, a grid electrode which controls the thermoelectrons emitted from the cathode portion, a target which generates X-rays by collisions of the thermoelectrons, and a voltage controller which controls voltages to be applied to the cathode portion and the grid electrode. The cathode portion includes a cathode made of porous tungsten impregnated with an excellent electron emitting material such as BaO, and a heater for heating and thereby allowing the cathode to emit the thermoelectrons.

DISCLOSURE OF THE INVENTION

In the above-described conventional X-ray generator, as shown in FIGS. 8A to 8E, a given voltage is applied by the voltage controller to the cathode portion, i.e. the heater for heating the cathode, by turning on a main power source (which is indicated as DRIVE SW in the diagram) of the X-ray generator. Simultaneously, a cutoff voltage is applied to the grid electrode so as not to allow the thermoelectrons to reach the target. Such application of the given voltage to the heater in advance (i.e. preheating of the heater) is important in order to emit desired stable X-rays simultaneously with inputting an ON-signal for X-ray emission. Thereafter, when the ON-signal for X-ray emission is inputted with an X-ray emission switch (which is indicated as X-RAY SW in the diagram), an operating voltage is applied to the grid electrode so as to set the quantity of the thermoelectrons colliding with the target to a given value, whereby the thermoelectrons collide with the target and generates X-rays.

In the conventional X-ray generator, the voltage required for emission of the thermoelectrons has been always applied to the heater of the cathode portion in order to emit the desired stable X-rays simultaneously with inputting the ON-signal for the X-ray emission. Incidentally, in the X-ray generator, there has been a case where a standby period in which the main power source is turned on and the X-ray emission is turned off, i.e. a preheated state of the heater, became extremely long depending on use conditions. Since the voltage required for emission of the thermoelectrons has been applied to the heater of the cathode portion even during this standby period as well, the cathode is worn out without emitting the X-rays. In this way, an X-ray tube maybe inefficiently operated depending on the use conditions. As a result, a shortened life of the cathode has resulted in a problem that a life of the X-ray tube was eventually shortened.

Accordingly, it is an object of the present invention to provide an X-ray generator which can generate X-rays for a longer period and more stably by operating an X-ray tube efficiently irrelevant to use conditions.

An X-ray generator according to the present invention comprises: (1) an X-ray tube including a cathode portion for emitting thermoelectrons, a grid electrode for controlling the thermoelectrons emitted from the cathode portion, and a target for generating X-rays by collisions of the thermoelectrons; (2) a voltage controller for controlling voltages to be applied to the cathode portion and the grid electrode; and (3) switches for operating turning on and off of the X-ray generator and turning on and off of X-ray emission. Here, the X-ray generator is characterized in that the voltage controller, based on an ON-signal for the X-ray generator and an OFF-signal for the X-ray emission through the switches, applies a positive standby voltage $V_{f1}$ to the cathode portion and applies a negative cutoff voltage $V_{c1}$ to the grid electrode so as to allow the thermoelectrons emitted from the cathode portion not to reach the target, and that the voltage controller, based on the ON-signal for the X-ray generator and an ON-signal for the X-ray emission through the switches, applies a cathode operating voltage $V_{f2}$ being higher than the standby voltage $V_{f1}$ to the cathode portion and applies a grid operating voltage $V_{c2}$ being higher than the cutoff voltage $V_{c1}$ to the grid electrode so as to allow the thermoelectrons emitted from the cathode portion to reach the target.

In this X-ray generator, the standby voltage $V_{f1}$, which is lower than the cathode operating voltage $V_{f2}$ applied when the switch for the X-ray emission is turned on, is applied to the cathode portion in the state where the switch for the X-ray generator is turned on and the switch for the X-ray emission is turned off. Therefore, as compared to the conventional X-ray generator in which the cathode operating voltage $V_{f2}$ is always applied to the cathode portion in the state where the switch for the X-ray generator is turned on, duration before attrition of the cathode portion is extended. Moreover, it is possible to emit desired stable X-rays simultaneously with turning on the switch for the X-ray emission. In this way, according to this X-ray generator, it is possible to obtain X-rays for a longer period and more stably by operating the X-ray tube efficiently irrelevant to use conditions.

Another X-ray generator according to the present invention comprises: (1) an X-ray tube including a cathode portion for emitting thermoelectrons, a grid electrode for controlling the thermoelectrons emitted from the cathode portion, and a target for generating X-rays by collisions of the thermoelectrons; (2) a voltage controller for controlling voltages to be applied to the cathode portion and the grid electrode; and (3) switches for operating turning on and off of the X-ray generator, turning on and off of the cathode portion, and turning on and off of X-ray emission. Here, the X-ray generator is characterized in that the voltage controller, based on an ON-signal for the X-ray generator, an OFF-signal for the cathode portion, and an OFF-signal for the X-ray emission through the switches, applies a positive standby voltage $V_{f1}$ to the cathode portion and applies a negative cutoff voltage $V_{c1}$ to the grid electrode so as to allow the thermoelectrons emitted from the cathode portion not to reach the target, that the voltage controller, based on the ON-signal for the X-ray generator, an ON-signal for the cathode portion, and the OFF-signal for the X-ray emission through the switches, applies a cathode operating voltage $V_{f2}$ being higher than the standby voltage $V_{f1}$ to the cathode portion and applies the cutoff voltage $V_{c1}$ to the grid electrode, and that the voltage controller, based on the ON-signal for the X-ray generator, the ON-signal for the cathode portion, and an ON-signal for the X-ray emission through the switches, applies the cathode operating voltage $V_{f2}$ to the cathode portion and applies a grid operating voltage $V_{c2}$ being higher than the cutoff voltage $V_{c1}$ to the grid electrode so as to allow the thermoelectrons emitted from the cathode portion to reach the target.

In this X-ray generator, the standby voltage $V_{f1}$, which is lower than the cathode operating voltage $V_{f2}$ applied when the switch for the cathode portion is turned on, is applied to the cathode portion in the state where the switch for the X-ray generator is turned on and the switch for the cathode portion is turned off. Therefore, as compared to the conventional X-ray generator in which the cathode operating voltage $V_{f2}$ is always applied to the cathode portion in the state where the switch for the X-ray generator is turned on, duration before attrition of the cathode portion is extended. Moreover, it is possible to emit desired stable X-rays simultaneously with turning on the switch for the X-ray emission. In this way, it is possible to obtain X-rays for a longer period and more stably by operating the X-ray tube efficiently irrelevant to use conditions. Particularly, according to this X-ray generator, it is possible to operate the voltage to be applied to the cathode portion freely between the standby voltage $V_{f1}$ and the cathode operating voltage $V_{f2}$ by use of the switch for operating turning on and off of the cathode portion. Therefore, if the switch for the cathode portion is turned on before starting the X-ray emission so that the voltage applied to the cathode portion is switched from the standby voltage $V_{f1}$ to the cathode operating voltage $V_{f2}$, it is possible to correspond immediately to emission of the X-rays when the switch for the X-ray emission is turned on, and to emit the X-rays having stable properties from an initial state of the X-ray emission.

Another X-ray generator according to the present invention includes: (1) an X-ray tube including a cathode portion for emitting thermoelectrons, a grid electrode for controlling the thermoelectrons emitted from the cathode portion, and a target for generating X-rays by collisions of the thermoelectrons; (2) a voltage controller for controlling voltages to be applied to the cathode portion and the grid electrode; and (3) switches for operating turning on and off of the X-ray generator, turning on and off of the cathode portion, and turning on and off of X-ray emission. Here, the X-ray generator is characterized in that the voltage controller, based on an ON-signal for the X-ray generator, an OFF-signal for the cathode portion, and an OFF-signal for the X-ray emission through the switches, does not apply a voltage to the cathode portion and does not apply a voltage to the grid electrode, that the voltage controller, based on the ON-signal for the X-ray generator, an ON-signal for the cathode portion, and the OFF-signal for the X-ray emission through the switches, applies a positive standby voltage $V_{f1}$ to the cathode portion and applies a negative cutoff voltage $V_{c1}$ to the grid electrode so as to allow the thermoelectrons emitted from the cathode portion not to reach the target, and that the voltage controller, based on the ON-signal for the X-ray generator, the ON-signal for the cathode portion, and an ON-signal for the X-ray emission through the switches, applies a cathode operating voltage $V_{f2}$ being higher than the standby voltage $V_{f1}$ to the cathode portion and applies a grid operating voltage $V_{c2}$ being higher than the cutoff voltage $V_{c1}$ to the grid electrode so as to allow the thermoelectrons emitted from the cathode portion to reach the target.

In this X-ray generator, no voltage is applied to the cathode portion when the switch for the X-ray generator is turned on and the switch for the cathode portion is turned off, and the standby voltage $V_{f1}$, which is lower than the cathode operating voltage $V_{f2}$ applied when the switch for the X-ray emission is turned on, is applied to the cathode portion in the state where the switch for the X-ray generator is turned on and the switch for the cathode portion is turned on while the switch for the X-ray emission is turned off. Therefore, as compared to the conventional X-ray generator in which the cathode operating voltage $V_{f2}$ is always applied to the cathode portion in the state where the switch for the X-ray generator is turned on, duration before attrition of the cathode portion is extended. Moreover, it is possible to emit desired stable X-rays simultaneously with turning on the switch for the X-ray emission. In this way, it is possible to obtain X-rays for a longer period and more stably by operating the X-ray tube efficiently irrelevant to use conditions. Particularly, according to the X-ray generator of this embodiment, it is possible to operate the voltage to be applied to the cathode portion freely between no voltage application and the standby voltage $V_{f1}$ by use of the switch for operating turning on and off of the cathode portion. Therefore, even in the state where the switch for the X-ray generator is turned on, it is still possible to stop the voltage application to the cathode portion. Accordingly, attrition of the cathode portion in a short period is further suppressed, and the X-rays can be obtained stably for a longer period by operating the X-ray tube more efficiently.

The X-ray generator according to the present invention may be also characterized in that the voltage controller stops application of the voltage to the cathode portion by turning off the switch for controlling ON and OFF of the cathode portion when a time period of application of the standby voltage $V_{f1}$ to the cathode portion goes on for a given time period or longer. In this way, application of the voltage to the cathode portion is automatically stopped when a user forgot to turn off the switch for the cathode portion, whereby attrition of the cathode portion in a short period is further suppressed, and the X-rays can be obtained stably for a still further longer period by operating the X-ray tube even more efficiently.

The X-ray generator according to the present invention may be also characterized in that the cathode portion is a cathode portion of an indirectly heated type which includes a cathode and a heater for heating the cathode. In this way, duration before attrition of the cathode is extended by controlling a voltage to be applied to the heater.

The X-ray generator according to the present invention may be also characterized in that the cathode portion is a cathode portion of a directly heated type which includes a filament. In this way, duration before attrition of the filament is extended by controlling a voltage to be applied to the filament.

BEST MODES FOR CARRYING OUT THE INVENTION

Figure 1:
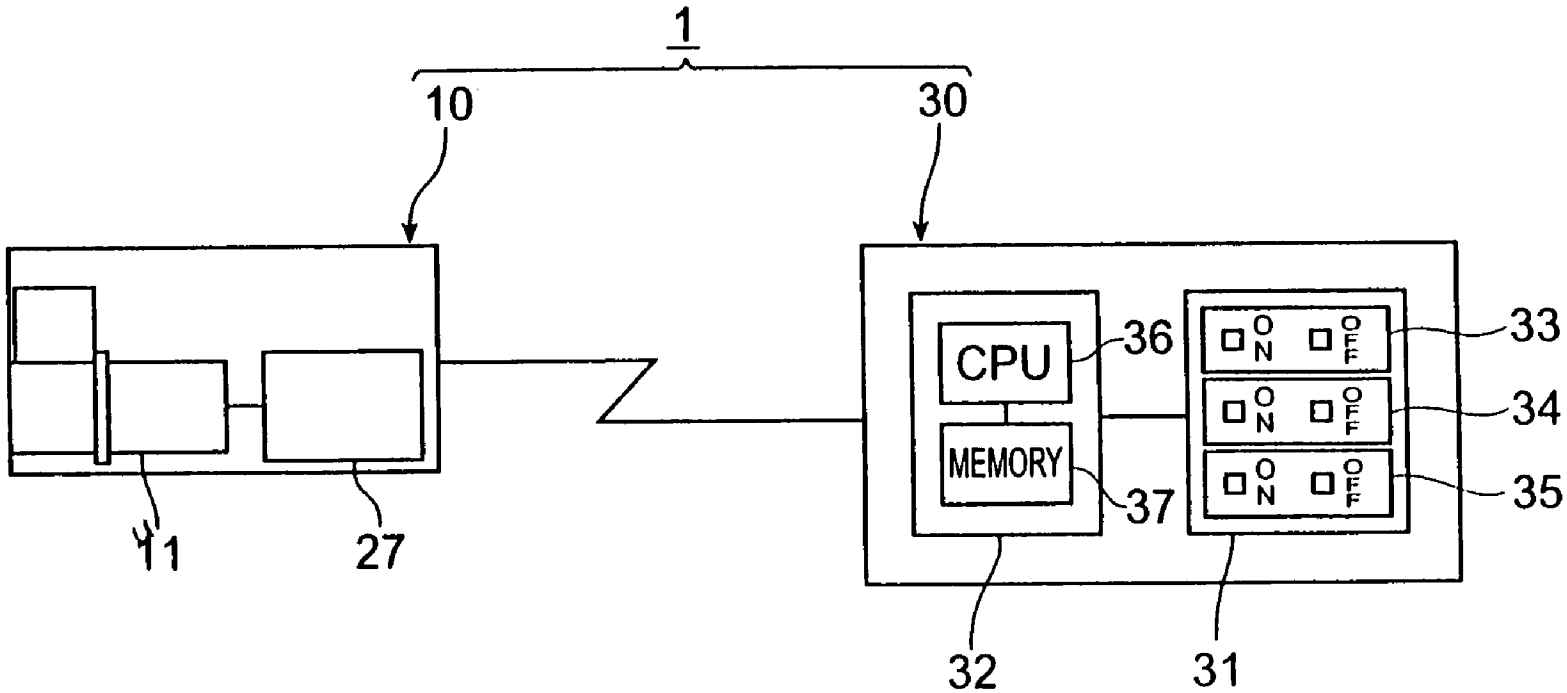
FIG. 1 is a view schematically showing a constitution of an X-ray generator according to an embodiment.

Now, preferred embodiments of an X-ray generator according to the present invention will be described with reference to the accompanying drawings. Note that the same elements are designated by the same reference numerals throughout the drawings, and duplicate explanations will be omitted.

Here, the X-ray generators according to the first to third embodiments to be described below have the same basic constitution. Therefore, the basic constitution of the X-ray generator will be collectively explained in the first place.

FIG. 1 is a view schematically showing a constitution of an X-ray generator according to any of the first to third embodiments. As shown in FIG. 1, the X-ray generator 1 includes an X-ray tube unit 10 for generating X-rays and a control unit 30 for controlling this X-ray tube unit 10.

The X-ray tube unit 10 includes an X-ray tube 11. The X-ray tube 11 may apply either an end window type or a side window type; however, description will be made in the embodiments regarding the X-ray tube 11 of an end window type.

Figure 2:
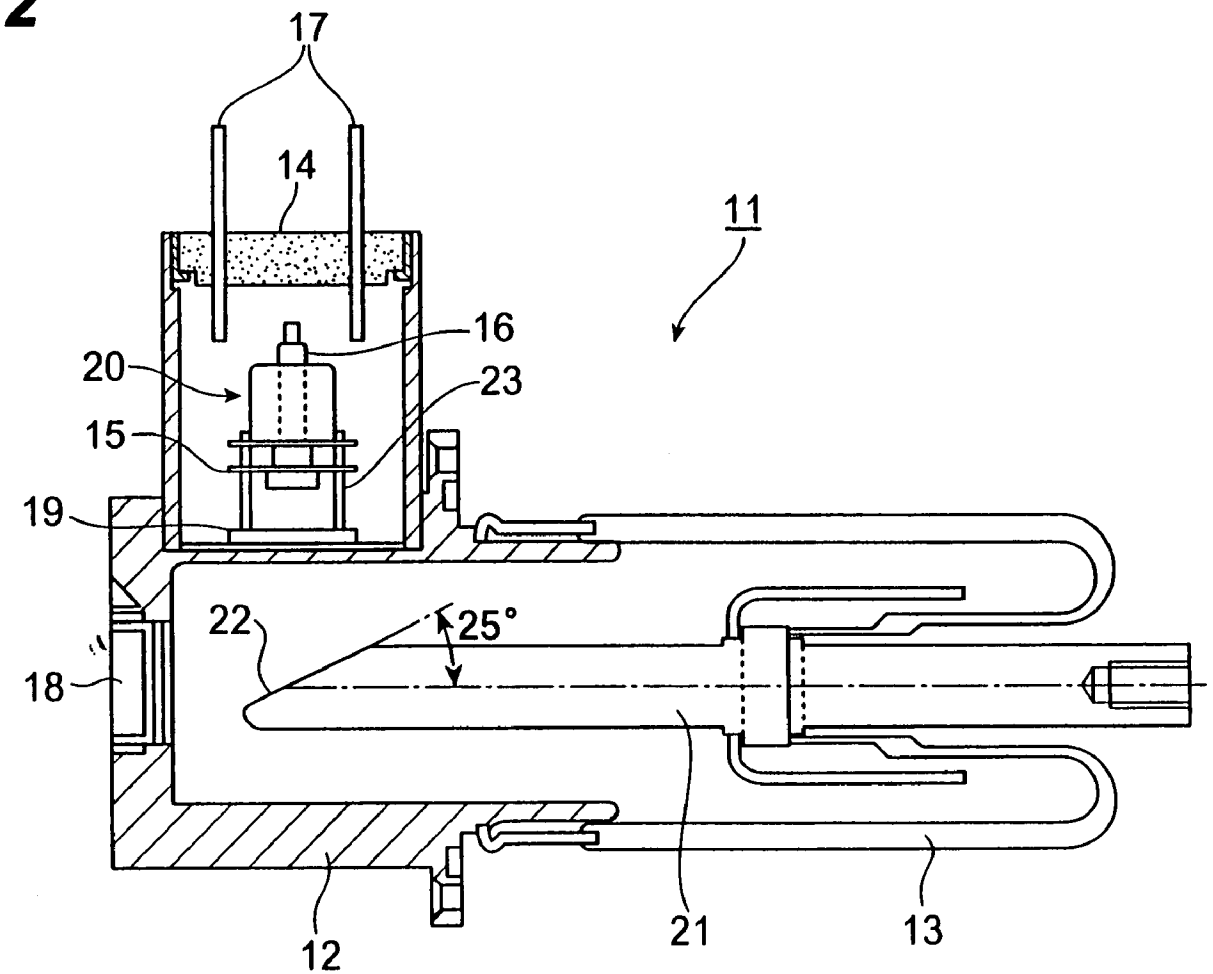
FIG. 2 is a cross-sectional view showing a structure of an X-ray tube of an end window type.

As shown in FIG. 2, the X-ray tube 11 is a microfocus X-ray tube, which is formed by combining a metal package 12 and a glass package 13. A ceramic stem 14 is fitted to one end of the package 12, and a plurality of pins 17 are inserted into the stem 14 for supplying voltages to a grid electrode 15 and a cathode 16 to be described later. Meanwhile, an X-ray emission window 18 made of beryllium is formed on a side face of this package 12.

Inside the packages 12 and 13, an electron gun 20 is disposed on the package 12 side, and a target base 21 made of oxygen-free copper or the like is disposed on the package 13 side. The electron gun 20 includes the cathode portion 16, the grid electrode 15, and a focus electrode 19. Meanwhile, a tungsten target 22 is brazed with silver on a tip of the target base 21.

The target 22 is disposed to be inclined by 25 degrees with respect to a perpendicular plane to tracks of thermoelectrons heading to the target 22. Since disposition of the target 22 is inclined in this way, the majority of generated X-rays are emitted out of the X-ray emission window 18.

Figure 3:
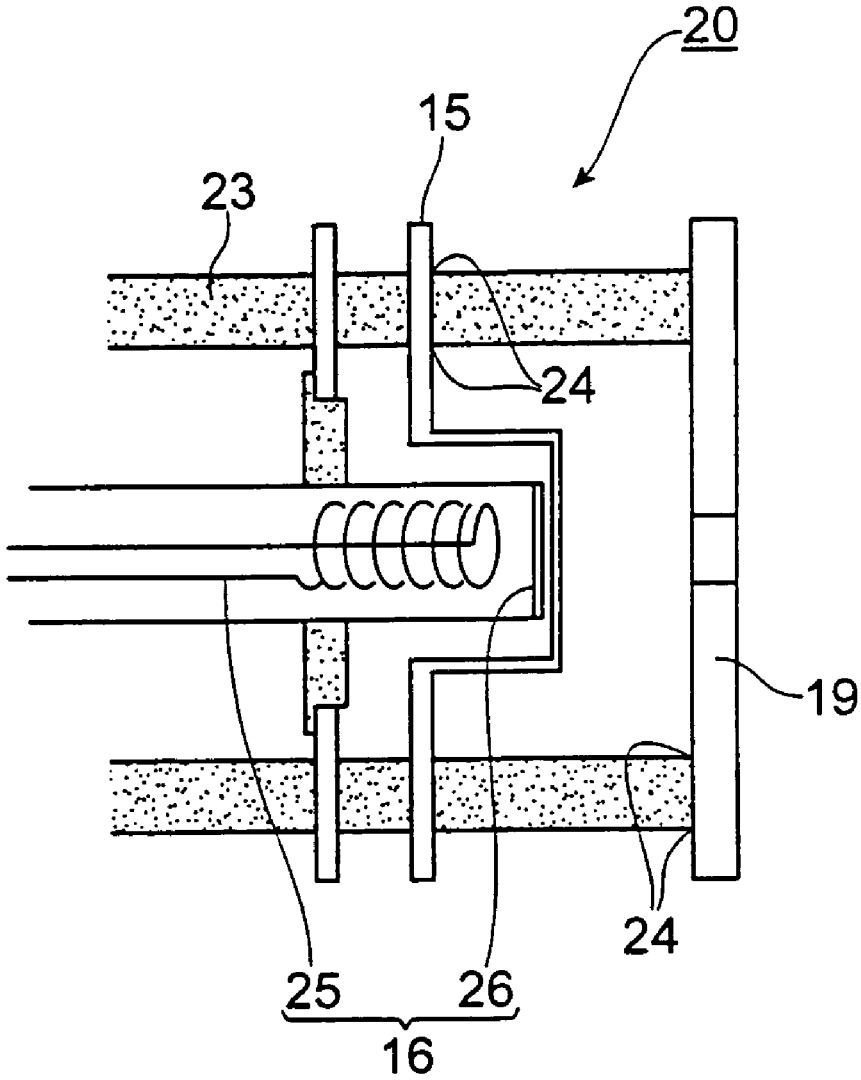
FIG. 3 is a cross-sectional view showing a structure of an electron gun.

FIG. 3 is a cross-sectional view showing a structure of the electron gun 20. As shown in FIG. 3, the cathode portion 16, the grid electrode 15, and the focus electrode 19 are fitted to braces 23 made of alumina or sapphire. As the material for the grid electrode 15 and the focus electrode 19, it is possible to use molybdenum which is excellent in heat resistance and heat radiation. Adhesion of the grid electrode 15 and the focus electrode 19 to the braces 23 is achieved by brazing with non-crystalline glass or silver 24. The cathode portion 16 includes a heater 25 and a cathode 26, which shows an indirectly heated type in which the cathode 26 is configured to be heated by heat of the heater 25. Here, the cathode portion 16 may be of a directly heated type including a filament, which is arranged to emit the thermoelectrons by applying a voltage to this filament. In the embodiments, description will be made regarding the cathode portion 16 of the indirectly heated type.

An impregnated cathode is used as the cathode 26. The impregnated cathode is formed by impregnating porous tungsten with an excellent electron emitting material such as BaO, CaO, or $Al_2O_3$, and an electron emitting surface thereof is coated with Os (osmium), Ir (iridium), Os/Ru (ruthenium) or the like. An operating temperature is lowered by this coating and the life of the cathode 26 is thereby extended.

The package 12 is formed of a nickel-copper alloy. The nickel-copper alloy is the metal which is excellent in heat conductivity and workability (especially weldability), and is low in gas emission. In this way, since the package 12 is made of the alloy with high heat conductivity, it is possible to discharge the heat generated inside the X-ray tube 11 efficiently outward, and thereby to extend the life of the X-ray tube 11 while reducing damages attributable to the heat.

Moreover, the package 12 has electric conductivity, and is always maintained at ground potential. Since the focus electrode 19 is connected to this package 12, the focus electrode 19 is always maintained at the ground potential as well. Accordingly, even if the electric potential of the target 22 changes, a shape of an electronic lens formed around the focus electrode 19 is kept constant. Accordingly, it is possible to stably maintain a micro focus of X-rays. Furthermore, since the electron gun 1—and the target 22 are surrounded by the package 12 which is maintained at the ground potential, turbulence of electric field distribution attributable to an influence from the outside is suppressed inside the package 12.

Meanwhile, the X-ray tube unit 10 includes a voltage generating circuit 27 for generating voltages to be supplied to the grid electrode 15, the target 22, and the cathode portion 16. Here, in this description, "a voltage to be applied to the cathode portion" refers to a voltage to be applied to the heater 25 regarding the above-described cathode portion 16 of the indirectly heated type and refers to a voltage to be applied to the filament regarding the cathode portion 16 of the directly heated type. This voltage generating circuit 27 is illustrated as common to the grid electrode 15, the target 22, and the cathode portion 16. However, the grid electrode 15, the target 22, and the cathode portion 16 may respectively have voltage generating circuits.

In this X-ray tube unit 10, when the cathode 26 is heated by heat generation of the heater 25 of the cathode portion 16 in accordance with application of the voltage thereto, the thermoelectrons are emitted from a surface of the cathode 26 at a certain temperature. The emitted thermoelectrons are accelerated by the grid electrode 15 and focused by the focus electrode 19, and then collide with the target 22. By collisions, the thermoelectrons are converted into X-rays and heat, and the generated X-rays are emitted out of the X-ray emission window 18. Meanwhile, the generated heat passes through the highly heat conductive target base 21 and is discharged outward.

As shown in FIG. 1, the control unit 30 includes an operating portion 31 and a controlling portion 32. The operating portion 31 is provided with a switch 33 for operating ON and OFF of the X-ray generator 1 itself, and a switch 34 for operating ON and OFF of X-ray emission. In the X-ray generators 1 according to the second and the third embodiments, the controlling portion 31 is further provided with a switch 35 for operating ON and OFF of the cathode portion 16.

The controlling portion 32 is provided with a memory 36 storing a program for controlling the voltage generating circuit 27, and a CPU 37 as operating means for administering overall operations of the X-ray generator 10. A voltage controller according to the embodiments will be formed of this controlling portion 32 and the voltage generating circuit 27.

In the X-ray generator 1 having the above-described basic constitution, the constitution of the controlling portion 32 is different among the first to the third embodiments. Accordingly, in the embodiments to be explained below, description will be made in detail primarily on the differences in the controlling unit 32.

(First Embodiment)

In the X-ray generator 1 according to the first embodiment, the memory 37 of the controlling portion 32 of the control unit 30 stores a program for controlling the voltage generating circuit 27 of the X-ray tube unit 10 as follows.

Specifically, as shown in 4A, FIG. 4B, FIG. 4C, FIG. 4D, and FIG. 4E, when the switch (which is indicated as DRIVE SW in the drawing) 33 for the X-ray generator 1 is turned off (the switch 34 for X-ray emission is consequently turned off), no voltage is applied to any of the grid electrode 15 and the heater 25 of the cathode portion 16. Thereafter, when the switch 33 for the X-ray generator 1 is turned on and the switch (which is indicated as X-RAY SW in the drawing) 34 for the X-ray emission is turned off, based on an ON-signal for the X-ray generator 1 and an OFF-signal for the X-ray emission, a positive standby voltage $V_{f1}$ is applied to the heater 25 of the cathode portion 16, and a negative cutoff voltage $V_{c1}$ is applied to the grid electrode 15 so as to allow the thermoelectrons emitted from the cathode 26 of the cathode portion 16 not to reach the target 22.

Moreover, when the switch 33 for the X-ray generator 1 is turned on and the switch 34 for the X-ray emission is turned on, based on the ON-signal for the X-ray generator 1 and an ON-signal for the X-ray emission, a cathode operating voltage $V_{f2}$ which is higher than the standby voltage $V_{f1}$ is applied to the heater 25 of the cathode portion 16, and a grid operating voltage $V_{c2}$ which is higher than the cutoff voltage $V_{c1}$ is applied to the grid electrode 15 so as to allow the thermoelectrons emitted from the cathode 26 of the cathode portion 16 to reach the target 22.

Figures 4A, 4B, 4C, 4D, 4E:
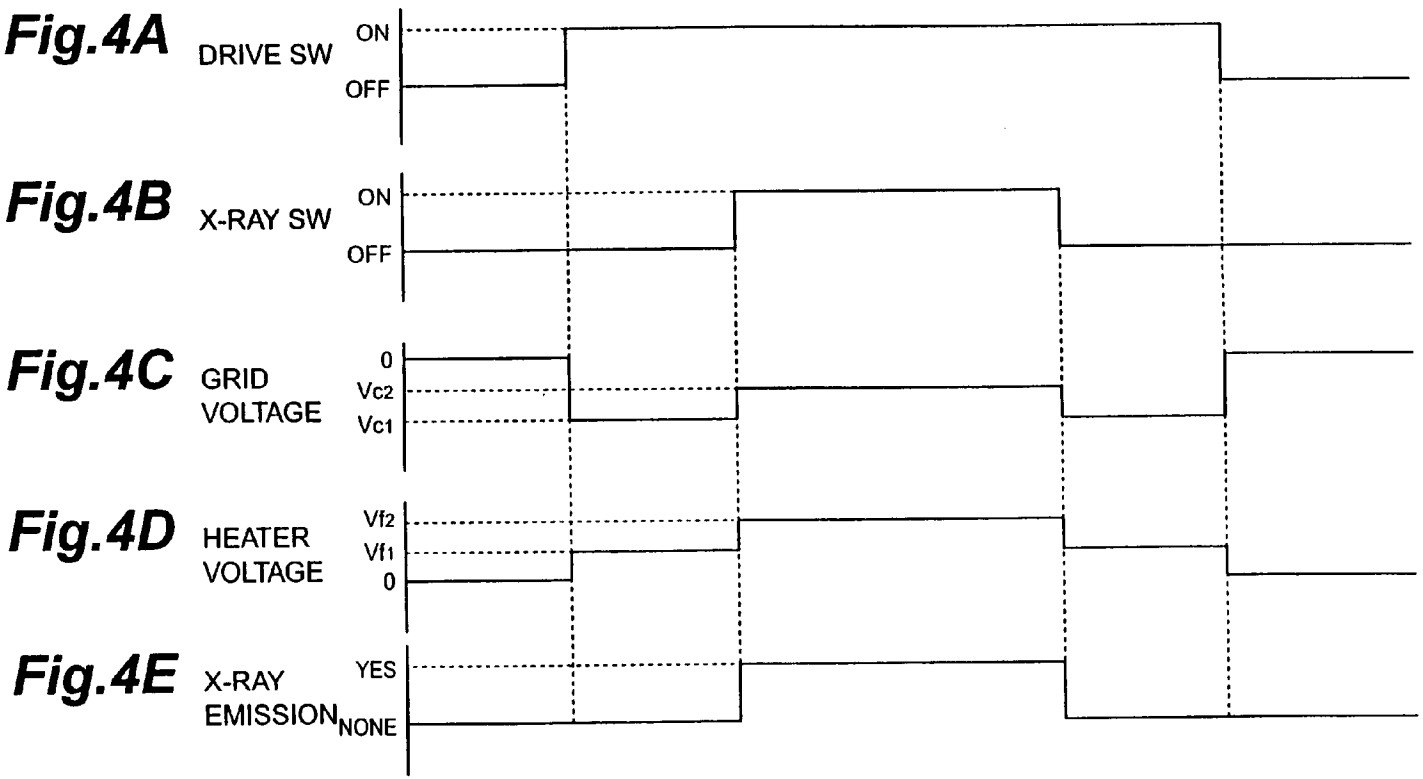
FIG. 4A, FIG. 4B, FIG. 4C, FIG. 4D, and FIG. 4E are views for explaining an operation of an X-ray generator according to a first embodiment.

In order to operate the X-ray generator according to this embodiment having the above-described constitution, as shown in FIG. 4A, the switch 33 for the X-ray generator 1 is firstly turned on. Then, as shown in FIG. 4D, the positive standby voltage $V_{f1}$ at about 3 volts is applied to the heater 25 of the cathode portion 16. Accordingly, the cathode 26 is warmed and set to a standby state so as to respond to the X-ray emission quickly. It is preferable that this standby voltage $V_{f1}$ is as small as possible. Simultaneously, as shown in FIG. 4C, a negative cutoff voltage $V_{c1}$ at about −200 volts is applied to the grid electrode 15 so as to allow the thermoelectrons emitted from the cathode 26 not to reach the target 22. In this way, the thermoelectrons emitted from the cathode 26 are prevented from reaching the target 22 in the standby state.

Thereafter, when starting the X-ray emission, the switch 34 for the X-ray emission is turned on as shown in FIG. 4B. Then, as shown in FIG. 4D, a cathode operating voltage $V_{f2}$ at about 6.3 volts, which is higher than the standby voltage $V_{f1}$, is applied to the heater 25 of the cathode portion 16. In this way, the cathode 26 is heated up to a high temperature, and a great amount of thermoelectrons are emitted from the cathode 26. Simultaneously, as shown in FIG. 4C, a grid operating voltage $V_{c2}$ which is higher than the cutoff voltage $V_{c1}$ is applied to the grid electrode 15 so as to allow the thermoelectrons emitted from the cathode 26 to reach the target 22. This grid operating voltage $V_{c2}$ is adjusted such that the quantity of the thermoelectrons emitted from the cathode 26 and colliding with the target 22 reaches a given value. In this way, the thermoelectrons emitted from the cathode 26 are accelerated by the grid electrode 15, are focused by the focus electrode 19, and then collide with the target 22. Then, the generated X-rays are emitted out of the X-ray emission window 19 (FIG. 4E).

When stopping the X-ray emission, the switch 34 for the X-ray emission is turned off as shown in FIG. 4B. Then, as shown in FIG. 4D, the standby voltage $V_{f1}$ is applied to the heater 25 of the cathode portion 16 and the cutoff voltage $V_{c1}$ is applied to the grid electrode 15, and then the standby state is reestablished.

When resuming the X-ray emission, the switch 34 is turned on again and the X-rays are emitted as described above. When stopping the X-ray emission, the switch 34 for the X-ray emission is turned off and the X-ray emission is stopped as described above. Moreover, when closing the use of the X-ray generator 1, the switch 33 for the X-ray generator 1 is turned off as shown in FIG. 4A. Then, as shown in FIG. 4C and FIG. 4D, application of the voltage to the heater 25 of the cathode portion 16 is stopped and application of the voltage to the grid electrode 15 is stopped, whereby the operation of the X-ray generator 1 is completely stopped.

As described above, according to the X-ray generator 1 of this embodiment, the standby voltage $V_{f1}$, which is lower than the cathode operating voltage $V_{f2}$ applied when the switch 34 for the X-ray emission is turned on, is applied to the heater 25 of the cathode portion 16 in the state where the switch 33 for the X-ray generator 1 is turned on and the switch 34 for the X-ray emission is turned off. Accordingly, as compared to the conventional X-ray generator in which the cathode operating voltage $V_{f2}$ is always applied to the heater 25 of the cathode portion 16 in the state where the switch 33 for the X-ray generator 1 is turned on, duration before attrition of the cathode 26 of the cathode portion 16 is extended. In this way, according to this X-ray generator 1, it is possible to obtain the X-rays for a longer period and more stably by efficiently operating the X-ray tube 11 irrelevant to use conditions.

(Second Embodiment)

In the X-ray generator 1 according to the second embodiment, the memory 37 of the controlling portion 32 of the control unit 30 stores a program for controlling the voltage generating circuit 27 of the X-ray tube unit 10 as follows.

Specifically, as shown in 5A, FIG. 5B, FIG. 5C, FIG. 5D, FIG. 5E, and FIG. 5F, when the switch 33 for the X-ray generator 1 is turned off (the switch 34 for the X-ray emission and a switch 35 for the cathode portion 16 are consequently turned off), no voltage is applied to any of the grid electrode 15 and the heater 25 of the cathode portion 16. Thereafter, when the switch 33 for the X-ray generator 1 is turned on, the switch (which is indicated as CATHODE PORTION SW in the drawing) 35 for the cathode portion 16 is turned off, and the switch 34 for the X-ray emission is turned off, based on an ON-signal for the X-ray generator 1, an OFF-signal for the cathode portion 16, and an OFF-signal for the X-ray emission, the positive standby voltage $V_{f1}$ is applied to the heater 25 of the cathode portion 16, and the negative cutoff voltage $V_{c1}$ is applied to the grid electrode 15 so as to allow the thermoelectrons emitted from the cathode 26 of the cathode portion 16 not to reach the target 22.

Moreover, when the switch 33 for the X-ray generator 1 is turned on, the switch 35 for the cathode portion 16 is turned on, and the switch 34 for the X-ray emission is turned off, based on the ON-signal for the X-ray generator 1, an ON-signal for the cathode portion 16, and the OFF-signal for the X-ray emission, the cathode operating voltage $V_{f2}$ which is higher than the standby voltage $V_{f1}$ is applied to the heater 25 of the cathode portion 16, and the above-described cutoff voltage $V_{c1}$ is applied to the grid electrode 15.

Moreover, when the switch 33 for the X-ray generator 1 is turned on, the switch 35 for the cathode portion 16 is turned on, and the switch 34 for the X-ray emission is turned on, the above-described cathode operating voltage $V_{f2}$ is applied to the heater 25 of the cathode portion 16, and the grid operating voltage $V_{c2}$ which is higher than the cutoff voltage $V_{c1}$ is applied to the grid electrode 15 so as to allow the thermoelectrons emitted from the cathode 26 of the cathode portion 16 to reach the target 22, based on the ON-signal for the X-ray generator 1, the ON-signal for the cathode portion 16, and an ON-signal for the X-ray emission.

Figures 5A, 5B, 5C, 5D, 5E, 5F:
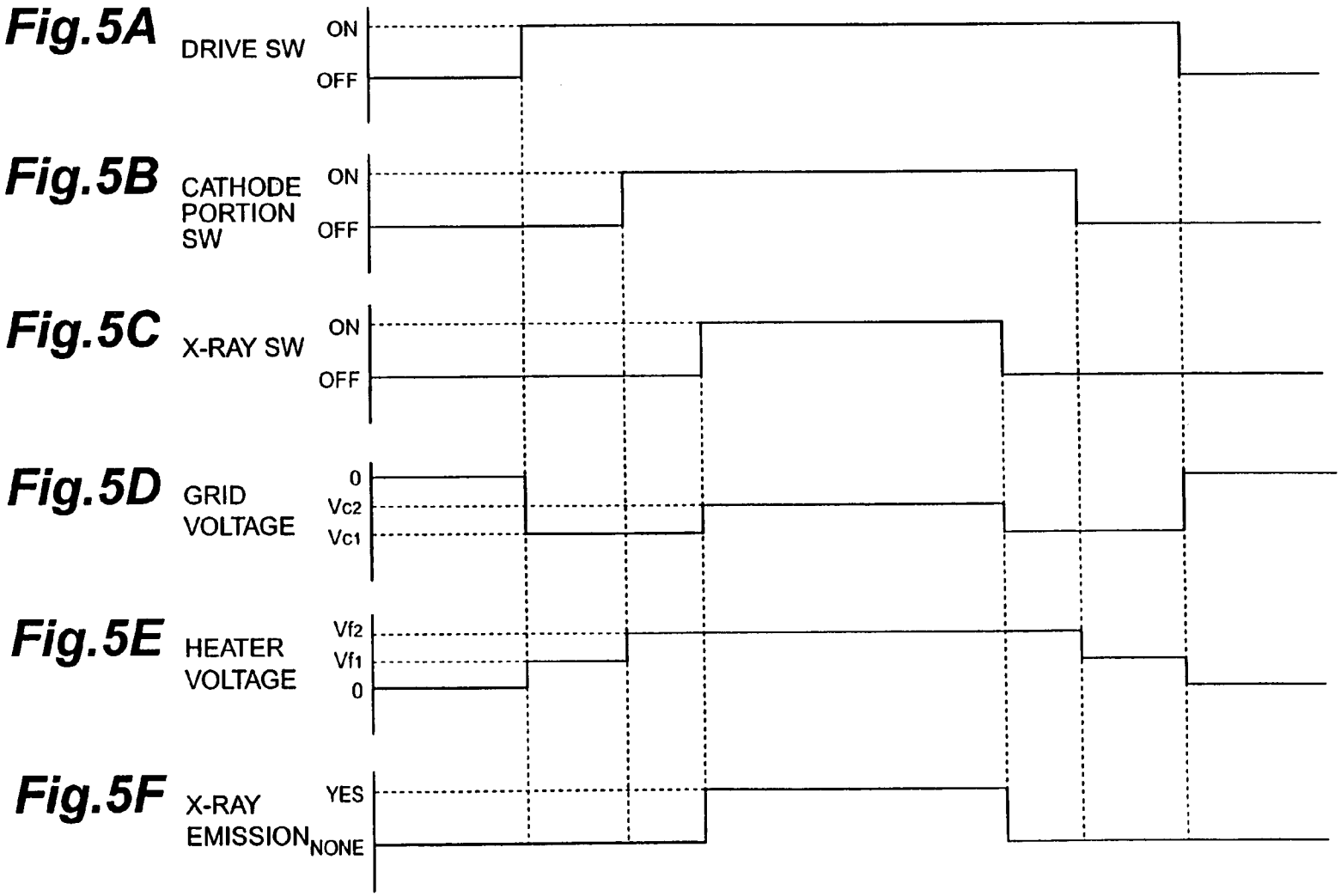
FIG. 5A, FIG. 5B, FIG. 5C, FIG. 5D, FIG. 5E, and FIG. 5F are views for explaining operations of an X-ray generator according to a second embodiment.

In order to operate the X-ray generator according to this embodiment having the above-described constitution, as shown in FIG. 5A, the switch 33 for the X-ray generator 1 is firstly turned on. Then, as shown in FIG. 5E, the positive standby voltage $V_{f1}$, which is about 3 volts, is applied to the heater 25 of the cathode portion 16. In this way, the cathode 26 is warmed and set to the standby state so as to respond to the X-ray emission quickly. It is preferable that this standby voltage $V_{f1}$ is as small as possible. Simultaneously, as shown in FIG. 5D, the negative cutoff voltage $V_{c1}$, which is about −200 volts, is applied to the grid electrode 15 so as to allow the thermoelectrons emitted from the cathode 26 not to reach the target 22. In this way, the thermoelectrons emitted from the cathode 26 are prevented from reaching the target 22 in the standby state.

Thereafter, when starting the X-ray emission, the switch 35 for the cathode portion 16 is turned on as shown in FIG. 5B. Then, as shown in FIG. 5E, the cathode operating voltage $V_{f2}$, which is about 6.3 volts, is applied to the heater 25 of the cathode portion 16. By this process, the cathode 26 which was in the standby state is heated by the heater 25 and is set to an operating state so as to correspond to a signal for the X-ray emission immediately. In this event, since the cutoff voltage $V_{c1}$ is applied to the grid electrode 15, the thermoelectrons emitted from the cathode 26 are prevented from reaching the target 22. Next, the switch 34 for the X-ray emission is turned on as shown in FIG. 5C. Then, as shown in FIG. 5D, the grid operating voltage $V_{c2}$ higher than the cutoff voltage $V_{c1}$ is applied to the grid electrode 15 so as to allow the thermoelectrons emitted from the cathode 26 to reach the target 22. This grid operating voltage $V_{c2}$ is adjusted such that the quantity of the thermoelectrons emitted from the cathode 26 and colliding with the target 22 reaches a given value.

Accordingly, the thermoelectrons emitted from the cathode 26 are accelerated by the grid electrode 15, are focused by the focus electrode 19, and then collide with the target 22. Then, the generated X-rays are emitted out of the X-ray emission window 19 (FIG. 5F).

When stopping the X-ray emission, the switch 34 for the X-ray emission is turned off as shown in FIG. 5C. Then, as shown in FIG. 5D, the above-described cutoff voltage $V_{c1}$ is applied to the grid electrode 15.

When resuming the X-ray emission, the switch 34 is turned on again and the X-rays are emitted as described above. Meanwhile, when stopping the X-ray emission, the switch 34 for the X-ray emission is turned off and the X-ray emission is stopped as described above. When setting the standby state, the switch 35 for the cathode portion 16 is turned off as shown in FIG. 5B.

Then, as shown in FIG. 5D and FIG. 5E, the above-described standby voltage $V_{f1}$ is applied to the heater of the cathode portion 16 and the above-described cutoff voltage $V_{c1}$ is applied to the grid electrode 15. Moreover, when closing the use of the X-ray generator 1, the switch 33 for the X-ray generator 1 is turned off as shown in FIG. 5A. Then, as shown in FIG. 5D and FIG. 5E, application of the voltage to the heater 25 of the cathode portion 16 is stopped and application of the voltage to the grid electrode 15 is stopped, whereby the operation of the X-ray generator 1 is completely stopped.

As described above, according to the X-ray generator 1 of this embodiment, the standby voltage $V_{f1}$, which is lower than the cathode operating voltage $V_{f2}$ applied when the switch 35 for the cathode portion 16 is turned on, is applied to the heater 25 in the state where the switch 33 for the X-ray generator 1 is turned on and the switch 35 for the cathode portion 16 is turned off. Accordingly, as compared to the conventional X-ray generator in which the cathode operating voltage $V_{f2}$ is always applied to the heater 25 of the cathode portion 16 in the state where the switch 33 for the X-ray generator 1 is turned ON, duration before attrition of the cathode 26 of the cathode portion 16 is extended. In this way, according to this X-ray generator 1, it is possible to obtain the X-rays for a longer period and more stably by efficiently operating the X-ray tube 11 irrelevant to use conditions.

In particular, in the X-ray generator 1 according to this embodiment, it is possible to operate the voltage to be applied to the heater 25 of the cathode portion 16 freely between the standby voltage $V_{f1}$ and the cathode operating voltage $V_{f2}$ by use of the switch 35 for operating turning on and off of the cathode portion 16. Therefore, if the switch 35 for the cathode portion 16 is turned on before starting the X-ray emission so that the voltage applied to the heater 25 of the cathode portion 16 is switched from the standby voltage $V_{f1}$ to the cathode operating voltage $V_{f2}$, it is possible to correspond immediately to emission of the X-rays when the switch 34 for the X-ray emission is turned on, and to emit the X-rays having stable properties from an initial state of the X-ray emission.

(Third Embodiment)

In the X-ray generator 1 according to the third embodiment, the memory 37 of the controlling portion 32 of the control unit 30 stores a program for controlling the voltage generating circuit 27 of the X-ray tube unit 10 as follows.

Specifically, as shown in 6A, FIG. 6B, FIG. 6C, FIG. 6D, FIG. 6E, and FIG. 6F, when the switch 33 for the X-ray generator 1 is turned off (the switch 34 for the X-ray emission and the switch 35 for the cathode portion 16 are consequently turned off), no voltage is applied to any of the grid electrode 15 and the heater 25 of the cathode portion 16. Moreover, when the switch 33 for the X-ray generator 1 is turned ON, the switch 35 for the cathode portion 16 is turned on, and the switch 34 for the X-ray emission is turned off as well, no voltage is applied to the heater 25 of the cathode portion 16 and no voltage is applied to the grid electrode 15, based on an ON-signal for the X-ray generator 1, an OFF-signal for the cathode portion 16, and an OFF-signal for the X-ray emission.

Meanwhile, when the switch 33 for the X-ray generator 1 is turned on, the switch 35 for the cathode portion 16 is turned on, and the switch 34 for the X-ray emission is turned off, the positive standby voltage $V_{f1}$ is applied to the heater 25 of the cathode portion 16, and the negative cutoff voltage $V_{c1}$ is applied to the grid electrode 15 so as to allow the thermoelectrons emitted from the cathode 26 of the cathode portion 16 not to reach the target 22, based on the ON-signal for the X-ray generator 1, an ON-signal for the cathode portion 16, and the OFF-signal for the X-ray emission.

Moreover, when the switch 33 for the X-ray generator 1 is turned on, the switch 35 for the cathode portion 16 is turned on, and the switch 34 for the X-ray emission is turned on, based on the ON-signal for the X-ray generator 1, the ON-signal for the cathode portion 16, and an ON-signal for the X-ray emission, the cathode operating voltage $V_{f2}$ which is higher than the above-described standby voltage $V_{f1}$ is applied to the heater 25 of the cathode portion 16, and the grid operating voltage $V_{c2}$ which is higher than the cutoff voltage $V_{c1}$ is applied to the grid electrode 15 so as to allow the thermoelectrons emitted from the cathode 26 of the cathode portion 16 to reach the target 22.

Figures 6A, 6B, 6C, 6D, 6E, 6F:
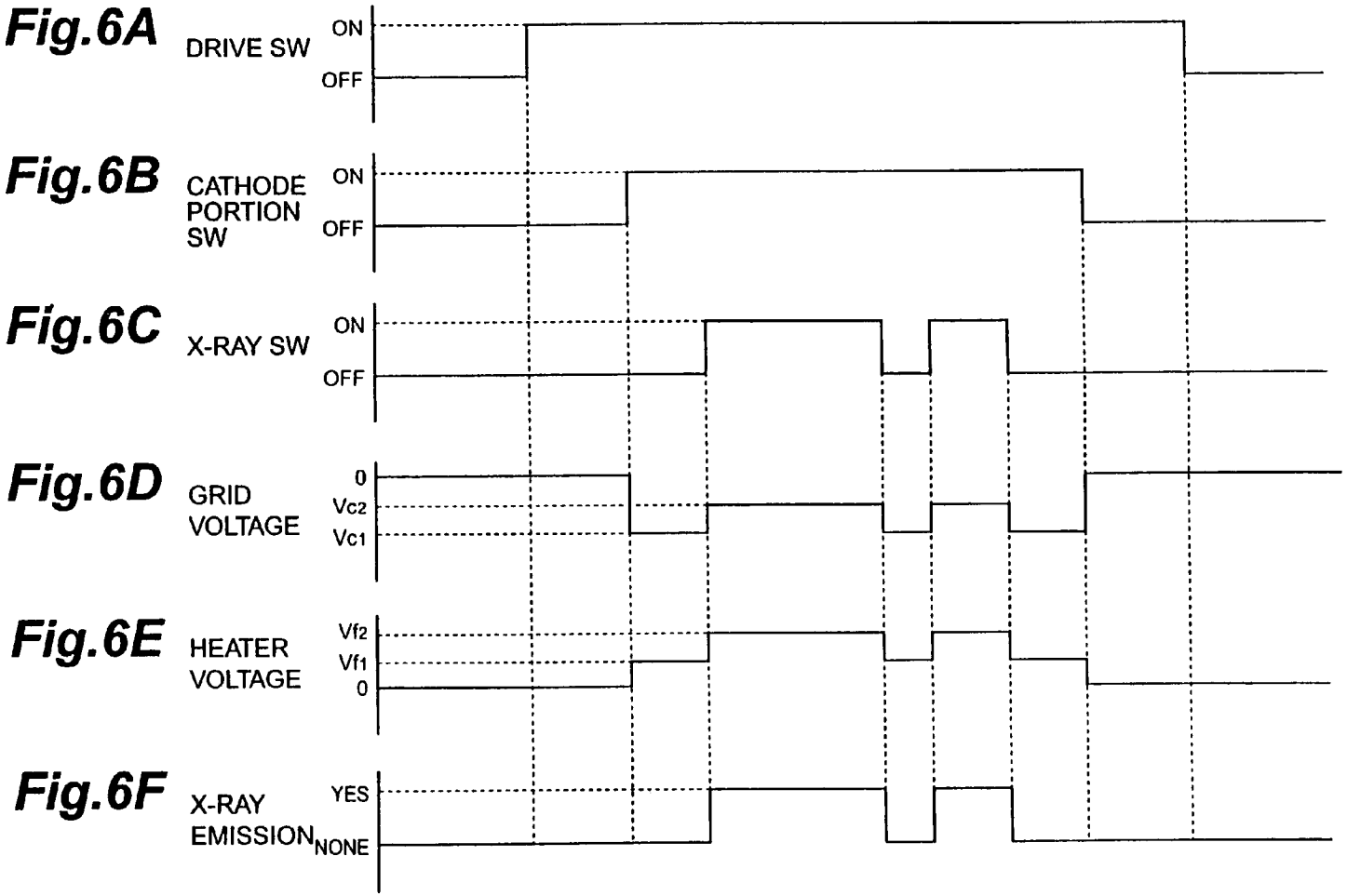
FIG. 6A, FIG. 6B, FIG. 6C, FIG. 6D, FIG. 6E, and FIG. 6F are views for explaining operations of an X-ray generator according to a third embodiment.
Figures 7A, 7B, 7C, 7D, 7E, 7F:
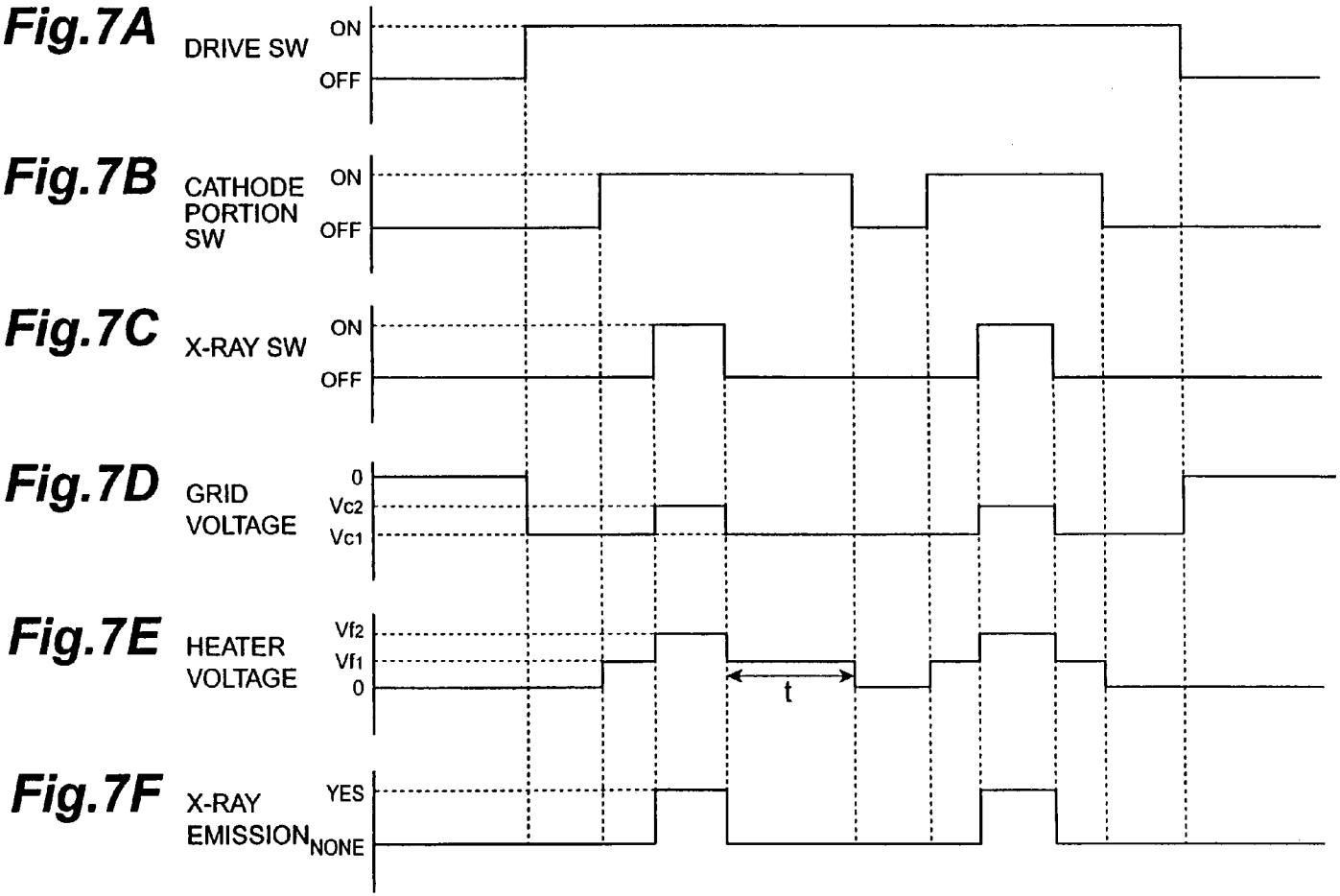
FIG. 7A, FIG. 7B, FIG. 7C, FIG. 7D, FIG. 7E, and FIG. 7F are views for explaining operations of an X-ray generator according to a modified example of the third embodiment.
Figures 8A, 8B, 8C, 8D, 8E:
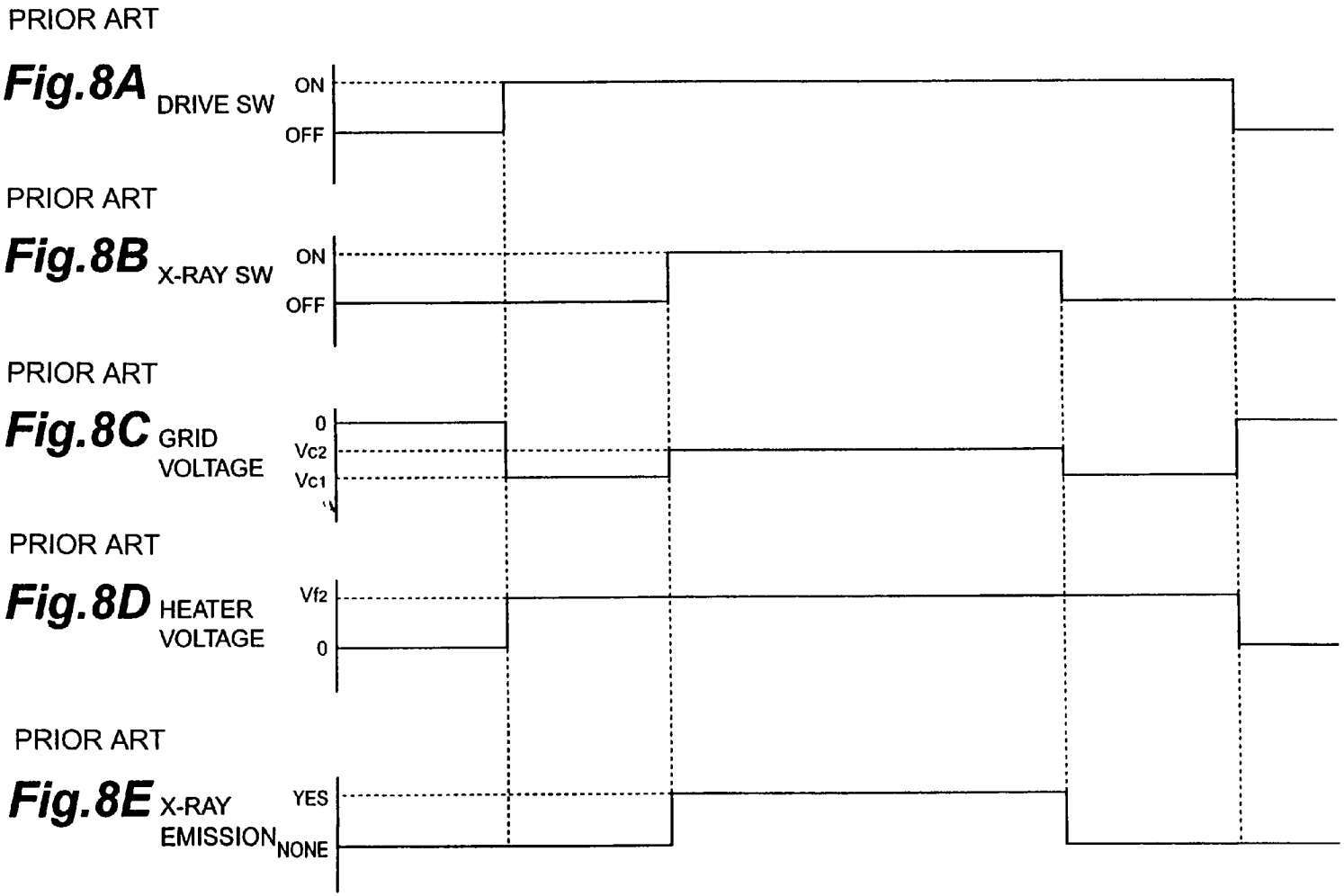
Fig.8A PRIOR ART
Fig.8B PRIOR ART
Fig.8C PRIOR ART
Fig.8D PRIOR ART
FIG. 8A, FIG. 8B, FIG. 8C, FIG. 8D, and FIG. 8E are views for explaining operations of a conventional X-ray generator.

In order to operate the X-ray generator according to this embodiment having the above-described constitution, as shown in FIG. 6A, the switch 33 for the X-ray generator 1 is firstly turned on. In this state, as shown in FIG. 5D and FIG. 6E, no voltage is applied to the grid electrode 15 or the heater 26 of the cathode portion 16.

Thereafter, when starting the X-ray emission, the switch 35 for the cathode portion 16 is firstly turned on as shown in FIG. 6B. Then, as shown in FIG. 6E, the standby voltage $V_{f1}$, which is about 3 volts, is applied to the heater 25 of the cathode portion 16. In this way, the cathode 26 is warmed by the heater 25 and set to the standby state so as to respond to the X-ray emission quickly. Simultaneously, as shown in FIG. 6D, the negative cutoff voltage $V_{c1}$ at about −200 volts is applied to the grid electrode 15 so as to allow the thermoelectrons emitted from the cathode 26 not to reach the target 22. In this way, the thermoelectrons emitted from the cathode 26 are prevented from reaching the target 22.

Next, the switch 34 for the X-ray emission is turned on as shown in FIG. 6C. Then, as shown in FIG. 6E, the cathode operating voltage $V_{f2}$, which is about 6.3 volts, is applied to the heater 25 of the cathode portion 16. Thereby, the cathode 26 is heated up to a high temperature, and a great amount of thermoelectrons are emitted from the cathode 26. Simultaneously, as shown in FIG. 6D, the grid operating voltage $V_{c2}$ which is higher than the cutoff voltage $V_{c1}$ is applied to the grid electrode 15 so as to allow the thermoelectrons emitted from the cathode 26 to reach the target 22. This grid operating voltage $V_{c2}$ is adjusted such that the quantity of the thermoelectrons emitted from the cathode 26 and colliding with the target 22 reaches a given value. Accordingly, the thermoelectrons emitted from the cathode 26 are accelerated by the grid electrode 15, are focused by the focus electrode 19, and then collide with the target 22. Then, the generated X-rays are emitted out of the X-ray emission window 19 (FIG. 6F).

When stopping the X-ray emission, the switch 34 for the X-ray emission is turned off as shown in FIG. 6C. Then, as shown in FIG. 6D and FIG. 6E, the standby voltage $V_{f1}$ is applied to the heater 25 of the cathode portion 16 and the cutoff voltage $V_{c1}$ is applied to the grid electrode 15.

When resuming the X-ray emission, the switch 34 for the X-ray emission is turned ON again and the X-rays are emitted as described above. Meanwhile, when stopping the X-ray emission, the switch 34 for the X-ray emission is turned off and the X-ray emission is stopped as described above. When setting the standby state, the switch 35 for the cathode portion 16 is turned off as shown in FIG. 6B. Then, as shown in FIG. 6D and FIG. 6E, application of the voltage to the heater 25 of the cathode portion 16 is stopped and application of the voltage to the grid electrode 15 is stopped. Moreover, when closing the use of the X-ray generator 1, the switch 33 for the X-ray generator 1 is turned off as shown in FIG. 6A. Then, the operation of the X-ray generator 1 is completely stopped.

As described above, according to the X-ray generator 1 of this embodiment, no voltage is applied to the heater 25 of the cathode portion 16 when the switch 33 for the X-ray generator 1 is turned ON and the switch 35 for the cathode portion 16 is turned off. Meanwhile, the standby voltage $Vf_1$, which is lower than the cathode operating voltage $V_{f2}$ applied when the switch 34 for the X-ray emission is turned on, is applied to the heater 25 of the cathode portion 16 in the state where the switch 33 for the X-ray generator 1 is turned on, the switch 35 for the cathode portion 16 is turned on, and the switch 34 for the X-ray emission is turned off. Accordingly, as compared to the conventional X-ray generator in which the cathode operating voltage $V_{f2}$ is always applied to the heater 25 of the cathode portion 16 in the state where the switch 33 for the X-ray generator 1 is turned on, duration before attrition of the cathode 26 of the cathode portion 16 is extended. In this way, it is possible to obtain the X-rays for a longer period and more stably by efficiently operating the X-ray tube 11 irrelevant to use conditions.

In particular, in the X-ray generator 1 according to this embodiment, it is possible to operate the voltage to be applied to the heater 25 of the cathode portion 16 freely between no voltage application and the standby voltage $V_{f1}$ by use of the switch 35 for operating turning on and off of the cathode portion 16. Therefore, it is possible to stop application of the voltage to the heater 25 of the cathode portion 16 even in the state where the switch 33 for the X-ray generator 1 is turned on. Accordingly, attrition of the cathode 26 in a short period is suppressed even more, and the desired X-rays can be stably obtained for a longer period by operating the X-ray tube 11 more efficiently.

Here, in the X-ray generator 1 according to this embodiment, as shown in 7A, FIG. 7B, FIG. 7C, FIG. 7D, FIG. 7E, and FIG. 7F, the memory 37 of the control unit 32 may store a program for controlling the voltage generator 27 so as to stop application of the voltage to the cathode portion 16 by automatically turning off the switch 35 for the cathode portion 16 when a time period t of application of the standby voltage $V_{f1}$ to the cathode portion 16 continues for a continuous given time period $t_m$ or longer, such as 30 minutes or longer. In this way, application of the voltage to the cathode portion 16 is automatically stopped even when a user forgets to turn off the switch 35 for the cathode portion 16, whereby attrition of the cathode 26 of the cathode portion 16 in a short period is further suppressed, and the X-rays can be obtained stably for even a longer period by operating the X-ray tube 11 even more efficiently.

As described above, the foregoing X-ray generator is an X-ray generator including a thermoelectron passage control gate disposed between the cathode portion 16 and an anode constituting a target for X-ray generation, which is characterized in that the cathode portion 16 maintains a given temperature in the state where the thermoelectron passage control gate is closed, and then application of heat to the cathode portion 16 is controlled such that the temperature of the cathode portion 16 is raised in the case of opening the thermoelectron passage gate. It is possible to heat the cathode portion 16 simultaneously with opening the thermoelectron passage control gate so as to raise the temperature of the cathode portion 16, or it is possible to heat the cathode before opening the thermoelectron passage control gate so as to raise the temperature of the cathode portion 16. Here, the above-described thermoelectron passage control gate means the grid electrode 15 which is provided with given electric potential.

Note that the present invention is not limited to the above-described embodiments, and various modifications are applicable. For example, in the above-described embodiments, description has been made regarding the X-ray tube 11 of the indirectly heated type, in which the cathode portion 16 includes the heater 25 and the cathode 26 and the cathode 26 is heated by the heat of the heater 25. However, the X-ray tube 11 may be of the directly heated type in which the cathode portion 16 includes the filament and the thermoelectrons are emitted by applying the voltage to this filament. In the X-ray tube 11 of the directly heated type, duration before attrition of the filament is extended by controlling the voltage to be applied to the filament of the cathode portion 16, and it is possible to obtain the X-rays stably for a longer period by efficiently driving the X-ray tube 11 irrelevant to use conditions.

INDUSTRIAL APPLICABILITY

The present invention is applicable to X-ray generators.

The invention claimed is:

1. An X-ray generator comprising:

an X-ray tube including:

a cathode portion for emitting thermoelectrons, a grid electrode for controlling the thermoelectrons emitted from the cathode portion, and a target for generating X-rays by collisions of the thermoelectrons;

a voltage controller for controlling voltages to be applied to the cathode portion and the grid electrode; and switches for operating turning on and off of the X-ray generator and turning on and off of X-ray emission, wherein the voltage controller, based on an ON-signal for the X-ray generator and an OFF-signal for the X-ray emission through the switches, applies a positive standby heating voltage $V_{f1}$ to the cathode portion and applies a negative cutoff voltage $V_{c1}$ to the grid electrode so as to allow the thermoelectrons emitted from the cathode portion not to reach the target, and the voltage controller, based on the ON-signal for the X-ray generator and an ON-signal for the X-ray emission through the switches, applies a cathode operating heating voltage $V_{f2}$ being higher than the standby heating voltage $V_{f1}$ to the cathode portion and applies a grid operating voltage $V_{c2}$ being higher than the cutoff voltage $V_{c1}$ to the grid electrode so as to allow the thermoelectrons emitted from the cathode portion to reach the target, wherein the positive standby heating voltage $V_{f1}$ is smaller than 6.3 V.

2. The X-ray generator according to claim 1, wherein the cathode portion is a cathode portion of an indirectly heated type, which comprises a cathode and a heater for heating the cathode.

3. The X-ray generator according to claim 1, wherein the cathode portion is a cathode portion of a directly heated type having a filament.

4. An X-ray generator comprising:

an X-ray tube including cathode portion for emitting thermoelectrons, a grid electrode for controlling the thermoelectrons emitted from the cathode portion, and a target for generating X-rays by collisions of the thermoelectrons;

a voltage controller for controlling voltages to be applied to the cathode portion and the grid electrode; and switches for operating turning on and off of the X-ray generator, turning on and off of the cathode portion, and turning on and off of X-ray emission, wherein the voltage controller, based on an ON-signal for the X-ray generator, an OFF-signal for the cathode portion, and an OFF-signal for the X-ray emission through the switches, applies a positive standby heating voltage $V_{f1}$ to the cathode portion and applies a negative cutoff voltage $V_{c1}$ to the grid electrode so as to allow the thermoelectrons emitted from the cathode portion not to reach the target, the voltage controller, based on the ON-signal for the X-ray generator, an ON-signal for the cathode portion, and the OFF-signal for the X-ray emission through the switches, applies a cathode operating heating voltage $V_{f2}$ being higher than the standby heating voltage $V_{f1}$ to the cathode portion and applies the cutoff voltage $V_{c1}$ to the grid electrode, and the voltage controller, based on the ON-signal for the X-ray generator, the ON-signal for the cathode portion, and an ON-signal for the X-ray emission through the switches, applies the cathode operating heating voltage $V_{f2}$ to the cathode portion and applies a grid operating voltage $V_{c2}$ being higher than the cutoff voltage $V_{c1}$ to the grid electrode so as to allow the thermoelectrons emitted from the cathode portion to reach the target, wherein the positive standby heating voltage $V_{f1}$ is smaller than 6.3 V.

5. An X-ray generator comprising:

an X-ray tube including a cathode portion for emitting thermoelectrons, a grid electrode for controlling the thermoelectrons emitted from the cathode portion, and a target for generating X-rays by collisions of the thermoelectrons;

a voltage controller for controlling voltages to be applied to the cathode portion and the grid electrode; and switches for operating turning on and off of the X-ray generator, turning on and off of the cathode portion, and turning on and off of X-ray emission, wherein the voltage controller, based on an ON-signal for the X-ray generator, an OFF-signal for the cathode portion, and an OFF-signal for the X-ray emission through the switches, does not apply a heating voltage to the cathode portion and does not apply a voltage to the grid electrode, the voltage controller, based on the ON-signal for the X-ray generator, an ON-signal for the cathode portion, and the OFF-signal for the X-ray emission through the switches, applies a positive standby heating voltage $V_{f1}$ to the cathode portion and applies a negative cutoff voltage $V_{c1}$ to the grid electrode so as to allow the thermoelectrons emitted from the cathode portion not to reach the target, and the voltage controller, based on the ON-signal for the X-ray generator, the ON-signal for the cathode portion, and an ON-signal for the X-ray emission through the switches, applies a cathode operating heating voltage $V_{f2}$ being higher than the standby heating voltage $V_{f1}$ to the cathode portion and applies a grid operating voltage $V_{c2}$ being higher than the cutoff voltage $V_{c1}$ to the grid electrode so as to allow the thermoelectrons emitted from the cathode portion to reach the target, wherein the positive standby heating voltage $V_{f1}$ is smaller than 6.3 V.

6. The X-ray generator according to claim 5, wherein the voltage controller stops application of the voltage to the cathode portion by turning off the switch for controlling ON and OFF of the cathode portion-when a time period of application of the standby heating voltage $V_{f1}$ to the cathode portion continues for a given continuous time period or longer.

* * * * *